United States Patent [19]

Jeromin

[11] 4,192,989

[45] Mar. 11, 1980

[54] BLANKET HEATED PHOTORECEPTOR

[75] Inventor: Lothar S. Jeromin, Sierra Madre, Calif.

[73] Assignee: Xerox Corporation, Stamford, Conn.

[21] Appl. No.: 813,037

[22] Filed: Jul. 5, 1977

[51] Int. Cl.[2] ..... H05B 1/00

[52] U.S. Cl. ..... 219/216; 219/201; 219/535; 219/536; 250/315.2

[58] Field of Search ..... 219/201, 216, 535, 536; 355/3 FU; 250/315 A, 315 R, 317-319

[56] References Cited

U.S. PATENT DOCUMENTS

| | | | |
|---|---|---|---|
| 3,791,843 | 2/1974 | Kohlmannsperger | 250/316 X |
| 3,939,345 | 2/1976 | Allan et al. | 250/315 A |

OTHER PUBLICATIONS

McMaster et al., "Xeroradiography in the 1970's,", *Materials Evaluation,* vol. 29, No. 12, Dec. 1971, pp. 265-274.

*Primary Examiner*—C. L. Albritton
*Attorney, Agent, or Firm*—Irving Keschner

[57] ABSTRACT

A heating system for relaxing xeroradiographic plates is disclosed which includes a thermofoil type heating system. This system is brought into thermal contact with a xeroradiographic plate to be relaxed. The thermofoil heating system includes a current resistive layer which when electrically energized converts electrical energy into thermal energy and two sandwiching layers which contain the current resistive layer. The sandwiching layers comprise a high dielectric strength high temperature resistance sheet material. In one embodiment, the thermofoil type heating system is configured so as to be brought into contact with the xeroradiographic plate to be relaxed. In another embodiment, the thermofoil type heating system is configured so as to reside on the xeroradiographic plate.

4 Claims, 6 Drawing Figures

CONVENTIONAL RELAXATION OVEN 40.1Ω SILICONE RUBBER THERMOFOIL

BLANKET HEATED PHOTORECEPTOR

This invention relates generally to xeroradiography and more specifically to method and means for relaxing xeroradiographic plates.

In conventional xeroradiography a photoreceptor comprising selenium, for example, is uniformly charged and then selectively exposed with x-ray radiation which is caused to pass through a subject resulting in the formation of a latent electrostatic image on the surface of the xeroradiographic plate. The latent electrostatic images are thereafter developed employing conventional powder cloud techniques for example, and thereafter transferred and fixed as desired. The photoreceptor employed must thereafter in an automatic xeroradiographic imaging configuration be reused by cleaning the photoreceptor surface and repeating the operation. It has been found necessary to heat the xeroradiographic plates in order to relax them to avoid ghosting or memory in the plate which is present by virtue of the operation of the previous cycle. Most conventional techniques employed in order to heat the xeroradiographic plates employ forced air heating or a convection type heating, or radiant type heating devices and conduction through air.

Relaxation usually includes heating the photoreceptor to approximately 130° F. and then letting it cool off in a 90° F. environment to remove trapped charges to the photoreceptor bulk which consequently eliminates ghost images. It is essential during the cycling of a xeroradiographic imaging system that the plates be properly heated in order to obtain acceptable image quality. Conversely, when improperly heated, i.e., overheating occurs, accelerating photoreceptor crystallization is experienced which leads to premature plate failure. Conventionally, the heating is accomplished by bringing the plate between two heated 140° F. platens for example, for about 2½ minutes without contacting them. The heat transfer between the platens and the photoreceptor takes place by convection-conduction through an air gap and some radiation. The photoreceptor temperature at the end of a 2½ minute heating period depends on its initial temperature which obviously must be controlled. Rapid successive relaxation cycles lead to overheating of the photoreceptor and the resulting crystallization described above.

In addition to obtaining repeatable x-ray exposure sensitivity between plates it has been found that there must be at charging, similar temperatures that is 90° F. plus or minus 3° F. Thus, the conventional conditioner elevator air temperature is maintained at 90° F. plus or minus 3° F. which exposes the plates to an elevated temperature thereby accelerating crystal growth.

It has been found that in order to properly relax these plates many times, times in the order of minutes, have been required which has become the limiting factor in decreasing cycling time. In addition, it has been found that both convection and radiant type heating systems are inefficient, noisy, and undesirable from a cleaning standpoint.

There is therefore a demonstrated need to provide a more effective heating means to relax xeroradiographic plates.

It is another object of this invention to provide a heating system devoid of the above noted deficiencies.

Still another object of this invention is to provide an efficient system for relaxing xeroradiographic plates.

Yet another object of this invention is to provide an improved system for heating xeroradiographic plates to increase throughput and consequently reduce cycle time of such systems.

Again another object of this invention is to provide a direct contact heating system which effectively employs the heat applied.

These and other objects of the instant invention are accomplished generally speaking by providing a direct contact thermofoil heating blanket which when electrically energized quickly and efficiently heats a xeroradiographic photoreceptor and relaxes same in very short time intervals to provide lower cycling times than heretofore realized. More specifically, each xeroradiographic plate may be equipped with a heating blanket which is permanently attached to the substrate throughout the useful life of plate in one embodiment of the system of the present invention or may be placed into contact with a thermofoil heating element in another embodiment of the system of the present invention. Typically the blanket includes an etched heating element sandwiched between two insulating high temperature sheets such as Kapton high temperature resistant high dielectric strength polyester material.

In one embodiment a thermofoil heater may be attached to the substrate of the xeroradiographic plate with pressure sensitive adhesive which provides intimate contact with the object to be heated. Adhesive allows removal of the blanket from a worn out or damaged plate and its reapplication and reuse in another xeroradiographic plate. Electrical energy applied to the heating element is efficiently converted into thermoenergy which raises the plate to the required relaxation temperature. For example, when a 10 watt per square inch heating element is employed, a plate temperature rise of 5° F. per second is observed. Illustratively therefore, when a 5° F. per second temperature rise is chosen as a desirable operating parameter, 1350 watts are required to heat a current size plate from 70° F. to 130° F. in 12 seconds. The plate temperature may be precisely and reliably controlled by employing a temperature sensor, for example, a thermistor embedded in the blanket in operable combination with a simple controller.

Power may be supplied to the heating element employing any conventional techniques for example, brush type electrodes may be employed which contact two exposed areas of the heating element. It should be noted that electrical connection to the temperature sensor may also be made with brush type electrodes among other conventional means.

In another embodiment of the heating system of the instant invention the blanket heater is separately deployed and is brought into contact with the xeroradiographic plate to be relaxed thereby eliminating the necessity of providing one heating element per xeroradiographic plate and the necessity of removing same when it is desired to salvage the heating element upon termination of the life of the xeroradiographic plate. In this configuration the blanket is bonded to for example, a thick resilient sheet which in turn is supported by a rigid plate. This sandwich construction is pressed against the plate substrate for the time required to heat the plate to the desired temperature. The load exerted on the plate by the sandwiched heater is counterbalanced by a support member which contacts the plate on the selenium free margin provided so that the plate surfaces are not in any way contacted and consequently damaged. The resilient foam backing for the heating blanket is chosen in order to assure uniform contact between the substrate and heating blanket and to minimize heat losses from the heating elements to the supporting medium. Electrical connections to the heating element and to the sensor are made by direct wiring. The temperature rise and temperature uniformity measured with this system are similar to the data obtained when the blanket is permanently affixed to the xeroradiographic plate.

It is found that when employing either of the two above referred to and described embodiments of the system of the instant invention, a fast plate temperature rise is obtained, the relaxation temperature employed can be controlled precisely and independently of initial temperature, uniform plate heating is obtained with wide density of the heating element being profiled to compensate for loss at the edges around possible photo timing openings, back bias contact and ground contact, and power consumption is substantially reduced.

Consequently, when fast temperature rises are obtained of the xeroradiographic plates being relaxes the heating may be done conveniently in a conventional processor without impacting throughput. For example, after completion of transfer, the lower plate transport is made to pause briefly, power is applied to the heating elements until the temperature controller shuts off the power. The heated plates then continue into the storage box in which the relaxation cycle is completed. Thus, relaxation heating in the processor substantially simplifies the conditioning unit conventionally employed in a xeroradiographic system. Further, after all plates have been relaxed the first plate in the elevator is maintained at the desired temperature while the others may be maintained at ambient thus prolonging plate life by consequently reducing crystallization growth rate. Heating the first plate on demand would increase the waiting or cycle time for a charged plate only by a few seconds which is acceptable.

The general concept of the heating system of the instant invention having been described the specifics of the heating system of the instant invention will be more nearly understood with respect to the drawings of which:

Figure 3:
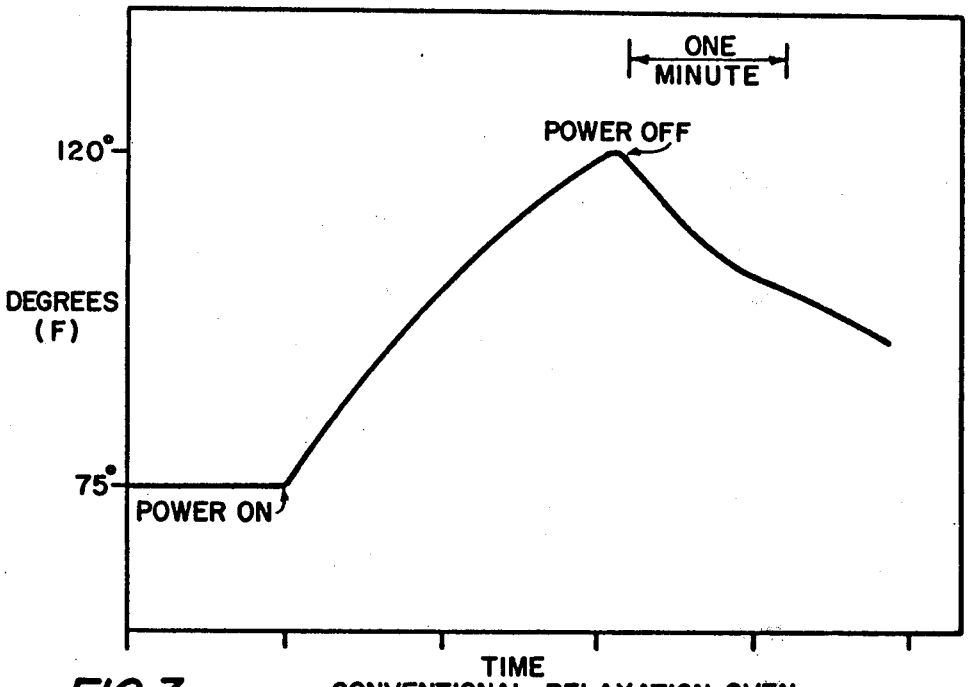
FIG. 3 PRIOR ART

In FIG. 3 is seen the rate of increase of temperature with time when employing a conventional heating means for xeroradiographic photoreceptors.

Figure 4:
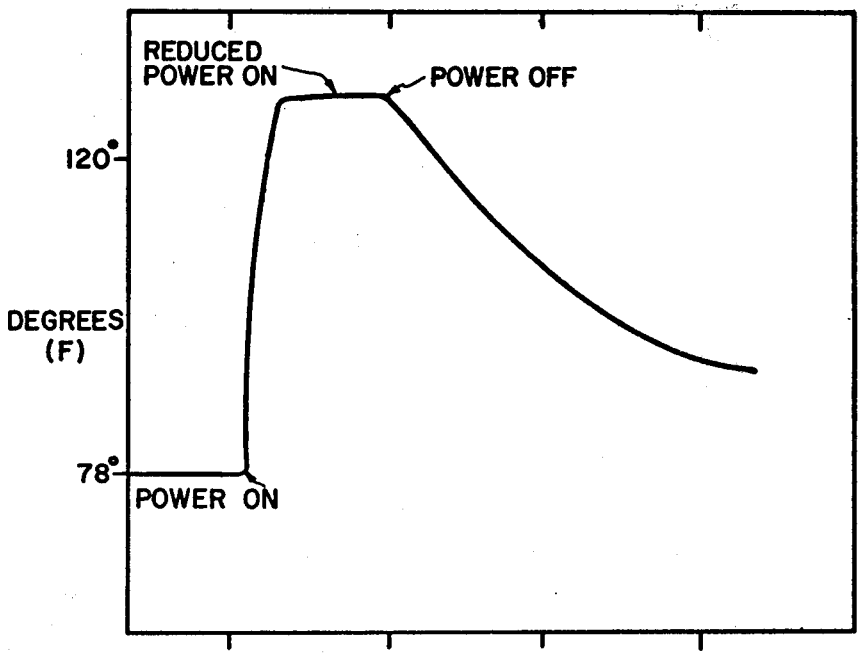

In FIG. 4 is seen the rate of temperature rise of the xeroradiographic plate when employing a Kapton thermofoil type heating device.

Figure 1:
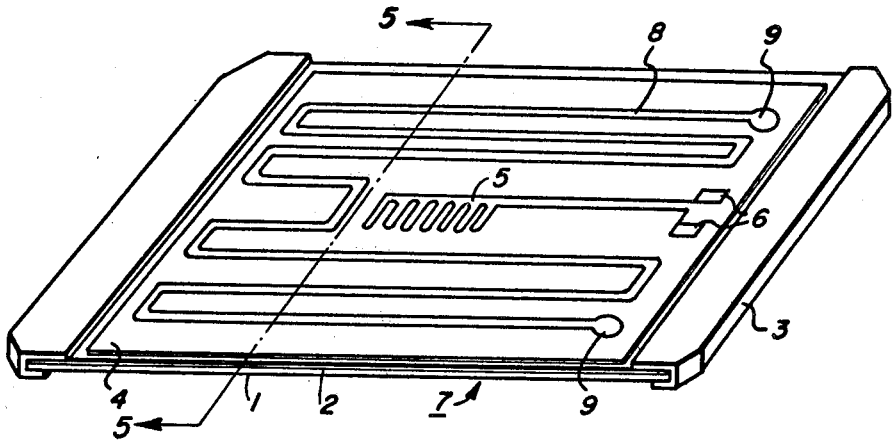
FIG. 1 illustrates a typical xeroradiographic plate with a thermofoil type heating element permanently affixed thereto.
Figure 5:
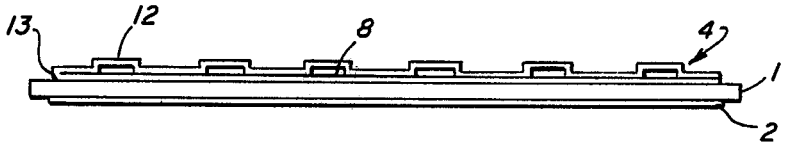

FIG. 5 is a cross sectional view along line 5—5 of FIG. 1.

Figure 2:
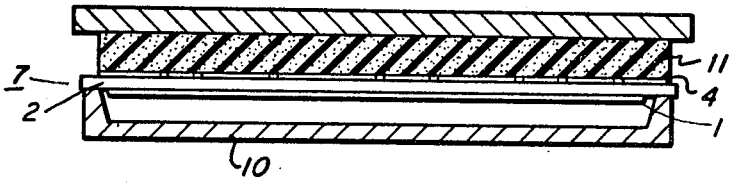
FIG. 2 illustrates a typical xeroradiographic plate which is brought into contact with a thermofoil type heating element of the system of the instant invention.
Figure 6:
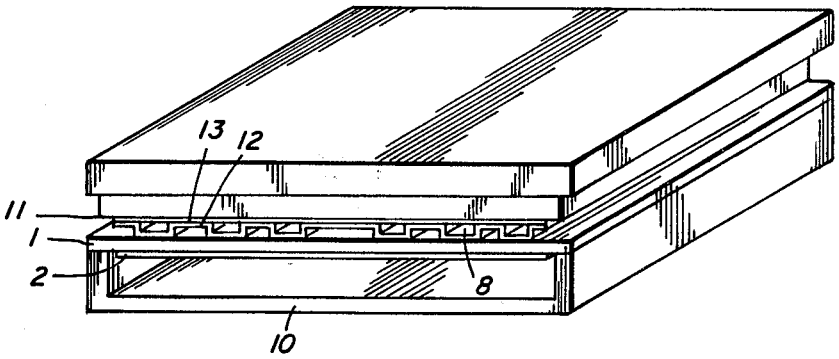

FIG. 6 is a perspective view of the xeroradiographic plate of FIG. 2

In FIG. 1 is seen a selenium coating 1 residing on a plate substrate 2 which is supported by plate rails 3. A thermofoil heating blanket generally designated as 4 is permanently affixed to the plate substrate 2 adhesively to provide proper thermal contact. The sensor 5 is in operable combination with sensor contacts 6 to control and sense the temperature of the xeroradiographic plate generally designated as 7. Heating elements 8 are electrically energized by heating element contacts 9 which by conduction raise the temperature of the plate substrate and consequentially the xeroradiographic plate to the desired relaxation temperature. The resistance of a temperature dependent sensor is measured with a conventional temperature controller and compared to some reference values. If the measured value differs from the reference value, power is applied to the heating element by means of the temperature controller. This controller may be one of any number of controllers including on-off, proportional, etc.

In FIG. 2 is seen illustratively, the embodiment of the heating system of the instant invention wherein the thermofoil heating type element 4 is brought into contact with the xeroradiographic plate 7 to be relaxed. A support member 10 is provided which comes into contact with the xeroradiographic plate 7 to be relaxed contacting same only at the non-selenium margins. A thermofoil blanket 4 is applied to a resilient foam backing 11 adhesively which in turn is compressed by a rigid plate which may be adhesively attached to the resilient foam in order to bring the thermofoil blanket 4 into proper and continuous thermal contact with the plate substrate 7. Temperature sensors and contacts as employed in FIG. 1 may also be employed in this configuration in the thermofoil type heating blanket.

Thus it can be seen from a comparison of FIGS. 3 and 4 that the temperature rise for the thermofoil direct heating system is magnitudes faster than conventional systems.

FIG. 5 is a cross section of the xeroradiographic plate shown in FIG. 1 along line 5—5 and shows in more detail the layers 12 and 13 and heating elements 8 which comprise blanket 4.

FIG. 6 is a perspective view of the embodiment of the invention shown in FIG. 2 and also shows the layers 12 and 13 and heating elements 8 which comprise blanket 4.

Any suitable material may be employed in the heating element of the system of the instant invention. The material normally comprising the heating elements is a resistive metal material which is capable upon electrical energization of providing sufficient resistivity in order to convert the electrical energy into thermal energy. Typical such metal materials include nickel chromium alloys and the like.

Any suitable sandwiching layer may be employed in the heating system of the instant invention which is electrically insulating and capable of withstanding high temperatures. Typical such material include Mylar, a polyester material, and Kapton, a polyimide, and silicone rubber.

Although the present examples were specific in terms of conditions and materials used, any of the above listed typical materials may be substituted when suitable in the above examples with similar results. In addition to the steps used to carry out the process of the present invention, other steps or modifications may be used if desirable. In addition, other materials may be incorporated in the system of the present invention which will enhance, synergize, or otherwise desirably affect the properties of the systems for their present use.

Anyone skilled in the art will have other modifications occur to him based on the teachings of the present invention. These modifications are intended to be encompassed within the scope of this invention.

What is claimed is:

1. An improved xeroradiographic plate having a heating member attached thereto for relaxing xeroradiographic plates, each xeroradiographic plate comprising a substrate and a photoreceptor layer overlying said substrate comprising:

a thermofoil type heating member which is attached to said substrate and in thermal contact therewith, said thermofoil member comprising a current resistive layer which upon electrical energization converts electrical energy into thermal energy and first and second layers disposed on opposite sides of said current resistive layer, said first and second layers comprising a high dielectric strength, high temperature resistant sheet material.

2. The system as defined in claim 1 wherein said current resistive layer comprises a resistive metal.

3. The system as defined in claim 2 wherein said resistive metal comprises nickel chronium alloys.

4. The improved plate as defined in claim 1 wherein said first and second layers are selected from the group consisting of polyimides and polyesters.

* * * * *